US007603833B2

(12) United States Patent
Koke

(10) Patent No.: US 7,603,833 B2
(45) Date of Patent: Oct. 20, 2009

(54) BAG OPENING APPARATUS AND METHOD

(75) Inventor: John Paul Koke, Duncan, SC (US)

(73) Assignee: Sealed Air New Zealand, Hamilton (NZ)

( * ) Notice: Subject to any disclaimer, the term of this patent is extended or adjusted under 35 U.S.C. 154(b) by 27 days.

(21) Appl. No.: 12/154,821

(22) Filed: May 27, 2008

(65) Prior Publication Data

US 2008/0229717 A1 Sep. 25, 2008

Related U.S. Application Data

(62) Division of application No. 10/504,885, filed as application No. PCT/NZ02/00290 on Dec. 20, 2002, now Pat. No. 7,392,637.

(30) Foreign Application Priority Data

Dec. 21, 2001 (NZ) ..... 516329
Dec. 21, 2001 (NZ) ..... 516330

(51) Int. Cl.
*B65B 11/22* (2006.01)

(52) U.S. Cl. ..... 53/468; 53/459; 53/564; 426/410

(58) Field of Classification Search ..... 53/457, 53/459, 468, 504, 564, 570, 571, 575, 576; 426/665, 410
See application file for complete search history.

(56) References Cited

U.S. PATENT DOCUMENTS 3,727,372 A 4/1973 Roberts
3,763,620 A 10/1973 Giraudi et al.
3,872,644 A * 3/1975 Giraudi et al. ..... 53/52
4,183,194 A 1/1980 Lucke
4,457,124 A * 7/1984 Hartmann ..... 53/512

(Continued)

FOREIGN PATENT DOCUMENTS

DE 1 272 806 7/1968

(Continued)

OTHER PUBLICATIONS

Meat New Zealand R&D, No. 51, dated Sep. 1999.*

(Continued)

*Primary Examiner*—Paul R Durand
(74) *Attorney, Agent, or Firm*—Mark B. Quatt

(57) ABSTRACT

An apparatus for packing products includes a product information acquisition stage arranged to acquire information relating to one or more characteristics of products on a product packing line; a bag supply system arranged to supply bags sequentially as individual products on a conveyor approach a packing apparatus; and a bag opener arranged to automatedly take up a bag from the bag supply system as each individual product approaches the bag opener, and to subsequently machine open a mouth of each bag to a controlled extent based on information relating to products being packed acquired at the upstream product information acquisition stage. An apparatus for packing products includes a product information acquisition stage arranged to acquire information relating to one or more characteristics of products on a product packing line; a product packing stage; and two or more generally parallel conveyors arranged to deliver products of different sizes to the packing stage.

8 Claims, 18 Drawing Sheets

U.S. PATENT DOCUMENTS

| | | | | | |
|---|---|---|---|---|---|
| 4,543,766 | A | | 10/1985 | Boshinski | |
| 4,553,376 | A | | 11/1985 | Okada et al. | |
| 4,780,830 | A | * | 10/1988 | Omi et al. | 700/219 |
| 5,157,903 | A | | 10/1992 | Nakashima et al. | |
| 5,255,495 | A | * | 10/1993 | Kovacs | 53/504 |
| 5,351,464 | A | | 10/1994 | Francioni | |
| 5,406,770 | A | | 4/1995 | Fikacek | |
| 5,463,844 | A | * | 11/1995 | Moehlenbrock et al. | 53/436 |
| 5,651,238 | A | * | 7/1997 | Belec et al. | 53/504 |
| 5,671,593 | A | | 9/1997 | Ginestra et al. | |
| 5,685,130 | A | | 11/1997 | Horsman | |
| 5,816,990 | A | | 10/1998 | Melville | |
| 5,826,405 | A | | 10/1998 | Killinger et al. | |
| 6,004,599 | A | * | 12/1999 | Bert et al. | 426/129 |
| 6,067,774 | A | * | 5/2000 | Sauer | 53/409 |
| 6,151,866 | A | * | 11/2000 | Connell | 53/443 |
| 6,267,661 | B1 | | 7/2001 | Melville | |
| 6,349,526 | B1 | | 2/2002 | Newman | |
| 6,374,580 | B1 | | 4/2002 | Kujubu et al. | |
| 6,672,038 | B2 | | 1/2004 | McGrane et al. | |
| 6,834,472 | B2 | | 12/2004 | Kujubu et al. | |
| 6,973,765 | B2 | | 12/2005 | Melville | |
| 6,996,948 | B2 | * | 2/2006 | Koke et al. | 53/55 |
| 7,388,968 | B2 | * | 6/2008 | Rodman | 382/106 |
| 7,392,637 | B2 | * | 7/2008 | Koke | 53/468 |

FOREIGN PATENT DOCUMENTS

| | | |
|---|---|---|
| EP | 1 197 433 A1 | 4/2002 |
| WO | WO 98/00338 | 1/1998 |
| WO | WO 98/14370 | 4/1998 |
| WO | WO 99/02409 | 1/1999 |
| WO | WO 99/12664 | 3/1999 |
| WO | WO 00/27706 | 5/2000 |
| WO | WO 01/89930 | 11/2001 |
| WO | WO 02/076832 | 10/2002 |

OTHER PUBLICATIONS

PCT/NZ2002/000290 International Search Report, 6 pages (Feb. 26, 2004).

PCT/NZ2002/000290 International Preliminary Examination Report, 5 pages (Apr. 21, 2004).

* cited by examiner

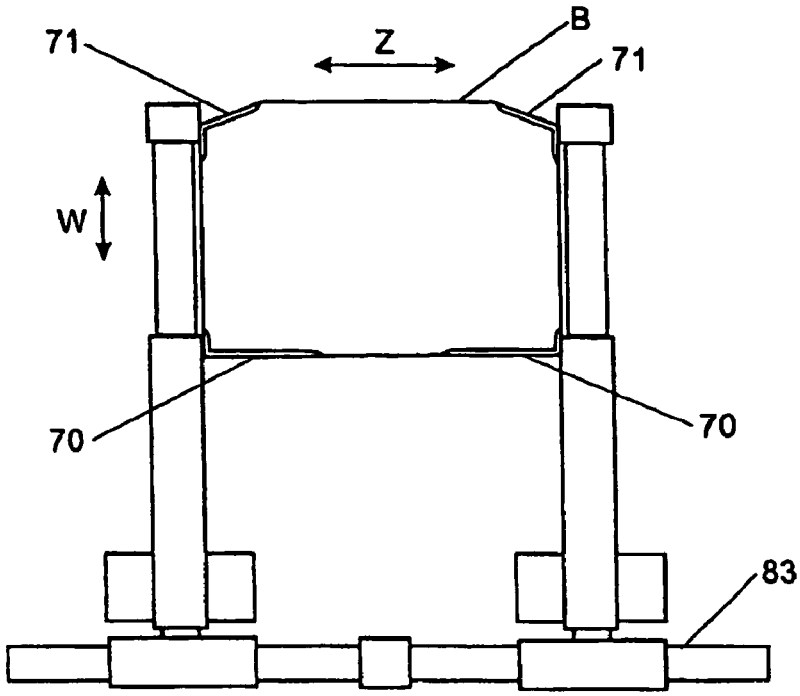
FIGURE 5C
FIGURE 5D
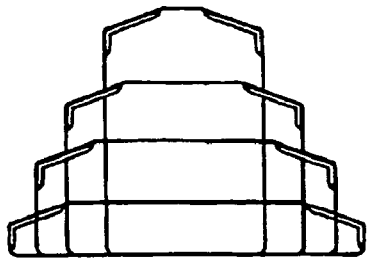
FIGURE 5E
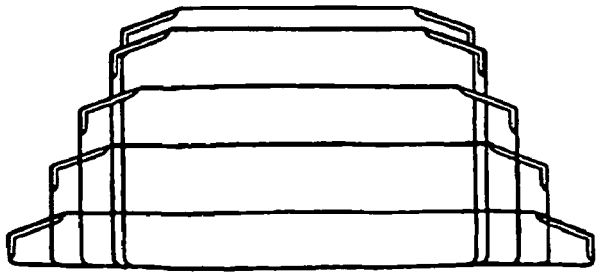

BAG OPENING APPARATUS AND METHOD

The present application is a divisional application of U.S. Ser. No. 10/504,885 filed May 23, 2005 now U.S. Pat. No. 7,392,637, which is a 35 USC §371 application of PCT/NZ02/00290 filed Dec. 20, 2002 which claims the benefit of New Zealand Patent Application No. 516329 filed Dec. 21, 2001 and New Zealand Patent Application No. 516330 filed Dec. 21, 2001.

FIELD OF THE INVENTION

The invention relates to the packing of products in flexible packaging and in particular bags or similar formed from a plastics material, and to the packing of irregularly sized products such as meat cuts in bags or similar.

BACKGROUND OF THE INVENTION

Typically in a meat processing plant carcasses are butchered to primal meat cuts which are then individually packed, typically in bags manually by operators on a packing line. The meat cuts on a conveyor will typically vary significantly in size.

In other applications there may be a need to bag products of varying size, or varying numbers of products per bag.

SUMMARY OF THE INVENTION

In a first aspect, an apparatus for packing products comprises:

a product information acquisition stage arranged to acquire information relating to at least one of the height, width, length, volume, and shape of individual products on a product packing line;

a bag supply system arranged to supply bags sequentially as individual products on a conveyor approach a packing apparatus; and a bag opener arranged to automatedly take up a bag from the bag supply system as each individual product approaches the bag opener, and to subsequently machine open a mouth of each bag to a variable extent of lift in a direction at approximately right angles to a major plane of the unopened bag and to a variable degree of width opening in a direction approximately in a major plane of the unopened bag, based on information relating at least one of the height, width, length, volume, shape, and weight of the product acquired at the product information acquisition stage.

In a second aspect, a method for packing products comprises:

at an upstream product information acquisition stage, acquiring information relating to at least one of the height, width, length, volume, or shape of individual products on a product packing line;

machine supplying bags sequentially as individual products on a conveyor approach a packing apparatus; and automatedly taking up on an automated bag opener a bag from the bag supply system as each individual product approaches the bag opener, and machine opening a mouth of the bag to a variable extent of lift in a direction at approximately right angles to a major plane of the unopened bag and to a variable degree of width opening in a direction approximately in a major plane of the unopened bag, based on information relating to at least one of the height, width, length, volume, shape, and weight of the product acquired at the upstream product information acquisition stage.

In a third aspect, a method for packing products comprises:

acquiring information relating to at least one of the height, width, length, volume, shape, and weight of products on a product packaging line, machine opening the mouth of each bag to a controlled extent based on information relating at least one of the height, width, length, volume, shape, and weight of the products being packed acquired at an upstream product information acquisition stage, and delivering or loading products into bags and into a vacuum packaging machine via two or more generally parallel load conveyors.

In a fourth aspect, a method for packing products comprises:

acquiring information relating to at least one of the height, width, length, volume, shape, and weight of products on a product packing line, and delivering or loading products into bags and into a vacuum packaging machine via two or more generally parallel load conveyors.

In a fifth aspect, an apparatus for packing products comprises:

a product information acquisition stage arranged to acquire information relating to at least one of the height, width, length, volume, and shape of products on a product packing line;

a product packing stage; and two or more generally parallel conveyors arranged to deliver products of different sizes to the packing stage.

In a sixth aspect, a method for packing products comprises:

acquiring information relating to one or more characteristics of products on a product packing line; and delivering products of different sizes to a product packing stage, via two or more generally parallel conveyors.

BRIEF DESCRIPTION OF THE DRAWINGS

The invention is further described with reference to the accompanying figures by way of example, wherein:

FIGS. 5A to 5E show steps in the operation of the bag opener of FIG. 4;

DETAILED DESCRIPTION OF THE INVENTION

Typically the bags will be plastic bags or sacks. Typically the bags will be sealed at one end and unsealed at the other. The bags are supplied to the packing apparatus sequentially, as individual products such as meat cuts approach, from a bulk supply such as a stack or rolled stock of bags for example, or alternatively may be made on-line to a standard length, or to the appropriate length tailored to the size of individual meat cuts, by cutting and sealing bags from tube stock for example.

The bag opening means will typically comprise one or more parts which insert into the mouth of each bag and spread the bag to a controlled extent of opening. Fingers inserted into the bag can open the bag to a variable extent of lift (the height direction, at approximately right angles to the plane of the unopened bag) combined with a variable degree of width opening, controlled dependent on product size. Alternatively means may grip the bag mouth from the exterior for controlled opening of the bag, rather than inserting into the interior of the mouth of the bag.

Information from the product information acquisition stage on product characteristics such as size can be used to deliver or load products by activating selected conveyors for the products. For example in a simple form two parallel conveyors may be provided, one of which delivers or loads smaller products and both of which are activated to run in parallel to deliver or load larger products. The two conveyors may have similar or different widths. In another form three or more parallel conveyors may deliver and load products. The conveyors may be "centered" i.e. a center conveyor may be flanked on either side by adjacent conveyors of a similar width which may be smaller or larger in width than the center conveyor, or may be non-centered.

In one embodiment the conveyors can be arranged to load products into the bags by telescoping or moving forward into the bags to an extent dependent upon the size of the product i.e. further for longer products than for shorter products, based on product size information previously acquired at the upstream product information acquisition stage.

The acquired information relating to the individual products such as individual meat cuts may include any one of dimensional information such as height information, width information, or height, width and length information, volume or shape information, or weight information, or a combination of one or more of any such information.

Figure 1:
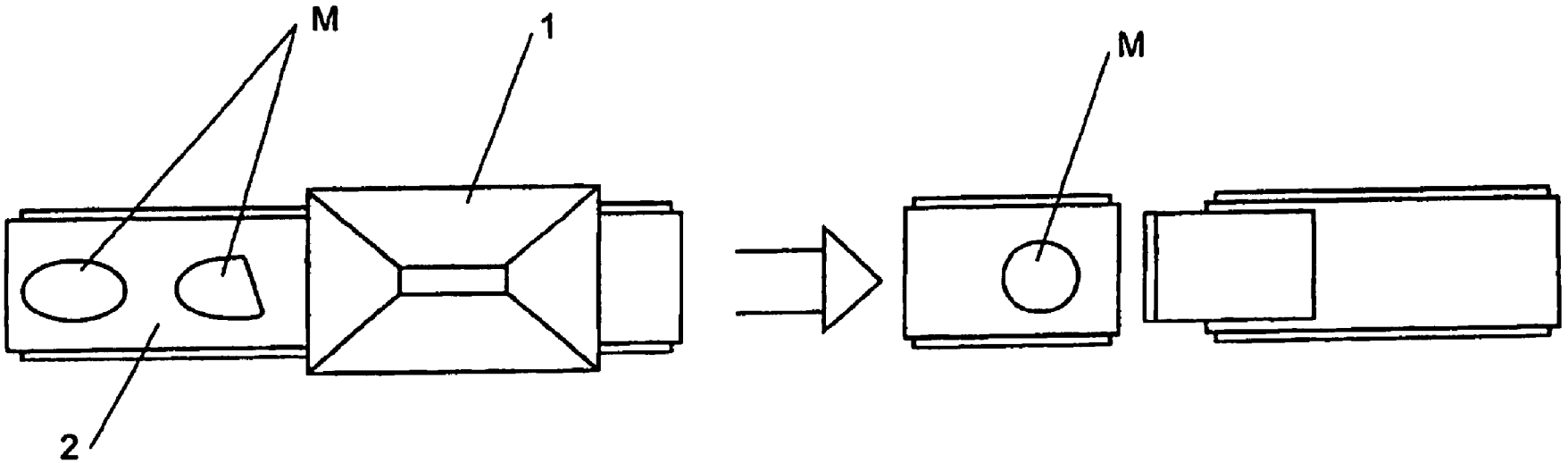
FIG. 1 is a schematic view of the overall layout of one embodiment of bagging apparatus.

Referring to FIG. 1, the packing apparatus of the invention comprises a product information acquisition stage 1 which may be a machine vision system beneath which individual products such as meat cuts M pass along conveyor 2. The machine vision system acquires information relating to one or more characteristics of the individual products such as meat cuts passing through the product information acquisition stage 1 on conveyor 2. As a minimum the product information acquisition stage 1 may acquire simple dimensional information relating to the individual products such as a combination of height and width, or height, width, and length information, or other dimensional information indicative of the size of the meat cuts or the volume or shape of the meat cuts. Weight information may supplement dimensional information acquired by the machine vision stage.

A product information acquisition stage 1 may comprise a digital camera system which "sees" individual meat cuts and/or a system which directs at least one beam or line from a scanning laser over individual meat cuts with deflection and/or reflection of laser light on the meat cut being seen by a camera system, and the resulting information being processed to provide the dimensional and/or volume or shape information in relation to each meat cut. Alternatively the product information acquisition stage may simply be a series of horizontal and vertical beams across the conveyor path at different heights or spacings through which the meat cuts pass, providing information to a control system as to the width and height and optionally length of the meat cuts based on the number of beams broken by each passing meat cut. Any other product information acquisition stage which enables the acquisition of information as to product length, width, size, volume, shape or similar may be used.

The acquired information may be supplied directly to individual electronic or programmed controllers for one or more bag openers, or to a common control system for a packing line which also controls other stages of the packing line, and synchronises the arrival of individual products at the bag opening stage. The acquired information can be used so that individual bags are opened to an extent which matches each individual product.

Figure 2:
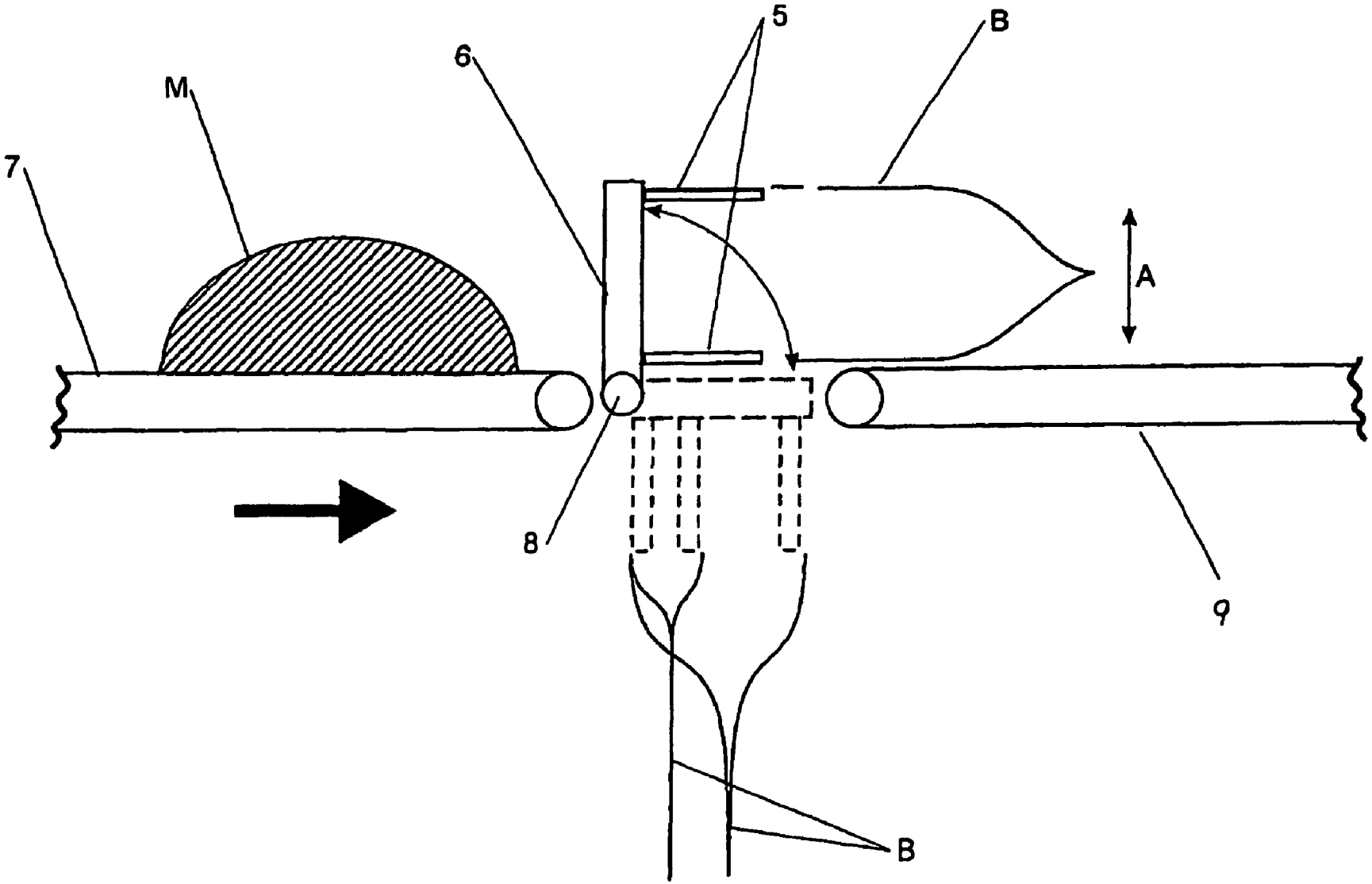
FIG. 2 is a schematic view of one embodiment of a bag opener.

FIG. 2 shows one form of bag openers which comprises parts such as fingers 5 which in operation of the packing apparatus insert into the mouth of each bag such as those indicated at B, and move apart to open the bag mouth to a controlled degree of height or lift. Similar parts or fingers (not shown in FIG. 2) may move in a lateral or width-wise direction to open the bag to a fixed or controlled degree of lateral opening. The degree of lift may be continuously variable dependent upon the size of the individual product or may be stepped between a number of predetermined levels of opening for products within broad size ranges. For each such a size the bag may be opened or spread laterally to a controlled degree of width which may be continuously variable dependent on product size, or to fixed steps of width opening. The lift opening fingers and width opening fingers may be controlled by servo motors which adjust the position of the lift and width opening of fingers for each bag, or by small pneumatic cylinders, or by any other suitable mechanical arrangement. The lift and width opening fingers may be mounted for vertical and horizontal movement on peripheral entry frame 6 as shown, or by any other suitable arrangement.

Typically products such as meat cut M in FIG. 2 will approach the bag opener on a conveyor such as conveyor 7 for example. In the bag opener of FIG. 2 the entry frame 6 carrying the spreader fingers is pivotally mounted at 8 so that it can pivot between the upper position shown in hard outline and the lower position shown in phantom outline. Prior to or as each product approaches, the spreader fingers enter the mouth of and pick up a fresh bag, and the entry frame 6 pivots upwardly (from the position shown in phantom outline to the position shown in hard outline). The spreader fingers are driven apart to open the bag to a controlled extent, based on information provided from the earlier machine vision or similar product information acquisition stage through which the product has passed. The open bag is thus presented to the product which is conveyed to the open bag, which is then caught by exit conveyor 9 which carries the bagged product onward, pulling the mouth of the bag from the spreader fingers 5. In FIG. 2 different degrees of opening of the bag mouth are shown in phantom outline at different positions of the spreader fingers 5.

Figure 3:
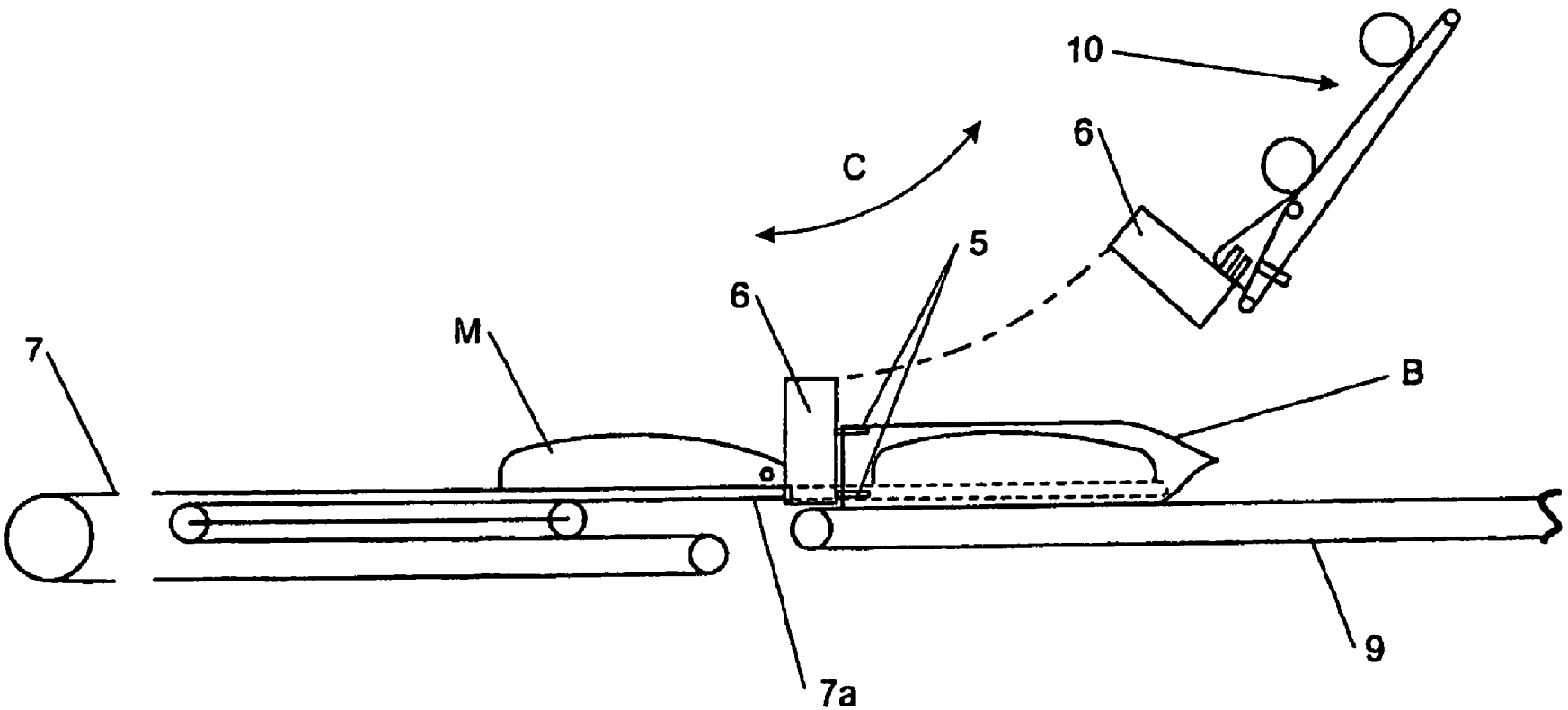
FIG. 3 is a schematic view of another embodiment of a bag opener.

The apparatus showing in FIG. 3 is similar in operation to that shown in FIG. 2 except that the bags are brought down into the product flow from above, rather than from below as in the apparatus of FIG. 2. In FIG. 3 the same reference numbers indicate the same components as in FIG. 2. Entry frame 6 carries lift and width opening fingers in a similar arrangement to the apparatus of FIG. 2. The entry frame 6 is mounted so as to pivotally move in the direction of arrow C from position 10 at which the spreader fingers enter the mouth of and pick up a fresh bag, to the lower position as shown. Prior to or during downward movement the spreader fingers 5 are driven apart to open the bag to a controlled extent, based on information provided from the earlier machine vision or similar product information acquisition stage through which the product has passed. Conveyor 7 has a telescoping forward end 7*a* which delivers the product through the entry frame 6 and into the open bag as the bag is brought down towards the telescoping conveyor end 7*a* extending over the exit conveyer 9, so that the product is entered into the bag and the bag is drawn over the product. The conveyor end 7*a* then withdraws leaving the product in the bag which is then caught by exit conveyor 9 which carries the bagged product onward, pulling the mouth of the bag from the spreader fingers 5, following which the entry frame returns to pick up a fresh bag from position 10.

In the embodiments of FIGS. 2 and 3 the product items move towards the bag which is stationary or relatively stationary. In an alternative arrangement however the open bags may be moved towards and/or drawn over the stationary or relatively stationary product item. It is also possible that as the product items move, the open bag may be moved to be drawn over the moving product item, so that the bag and product item such as meat cuts are moving towards each other as the product is entered into the bag.

A control system may synchronise the arrival of individual meat cuts with the acquired information relating to the individual meat cuts. Alternatively the product information acquisition stage and bagging station may be autonomous, and where bags are opened according to product weight and for example a weighing conveyor may be positioned immediately upstream of the bagging stage. In another arrangement acquired information relating to each product may be sent directly from the product information acquisition stage to the packing station and retained in a database at the packing station until that meat cut has arrived, and is then used to open the bag to the appropriate extent for that size of product. In a yet more sophisticated arrangement individual meat cuts may be tracked along a packing line so that the system can detect if any individual meat cut is removed from the product stream for any reason, to avoid mis-indexing of the meat cuts and bags, and this may be achieved by detecting and tracking the movement of each meat cut from one conveyor to the next.

In the embodiments of FIGS. 2 and 3 the spreader fingers move height-wise (lift) and width-wise to open the mouth of the bag to a rectangular or square shape. This is not essential and the spreader fingers or equivalent may be positioned to open the mouth of the bag to a non-regular shape more adapted to the shape of the product dynamically, as the product is loaded. A further possibility is that the spreader fingers or equivalent may be dynamically opened and closed as the product enters the bag. For example for a hump back-shaped product such as a typical meat cut, the fingers may open the bag to a controlled degree and then as the product is entered into the bag continue opening the bag as the highest part of the product passes through the bag opening, and then begin to close the bag as the trailing portion of the product enters the bag, and optionally near-fully or partially close the bag. For this purpose the spreader fingers may grip the periphery of the bag mouth. For example a 3D image of the product may be acquired at the product information acquisition stage and a multiple number of spreader fingers moved to duplicate the shape of the product, and open the bag to the shape of the product, as the product is loaded. Other similar variations are possible.

As indicated previously, bags may be supplied from a stack or rolled stock or alternatively may be made on-line by cutting and sealing bags from tubes, preferably to a length for each bag tailored to the size of individual products. A range of bag or stock widths may be available in a range of materials such as oxygen barrier materials, export grade packing material, and so forth from which the bags may be selected as directed by the control system. Bags preprinted with different labelling or branding information may also be provided and selected from.

Figure 4:
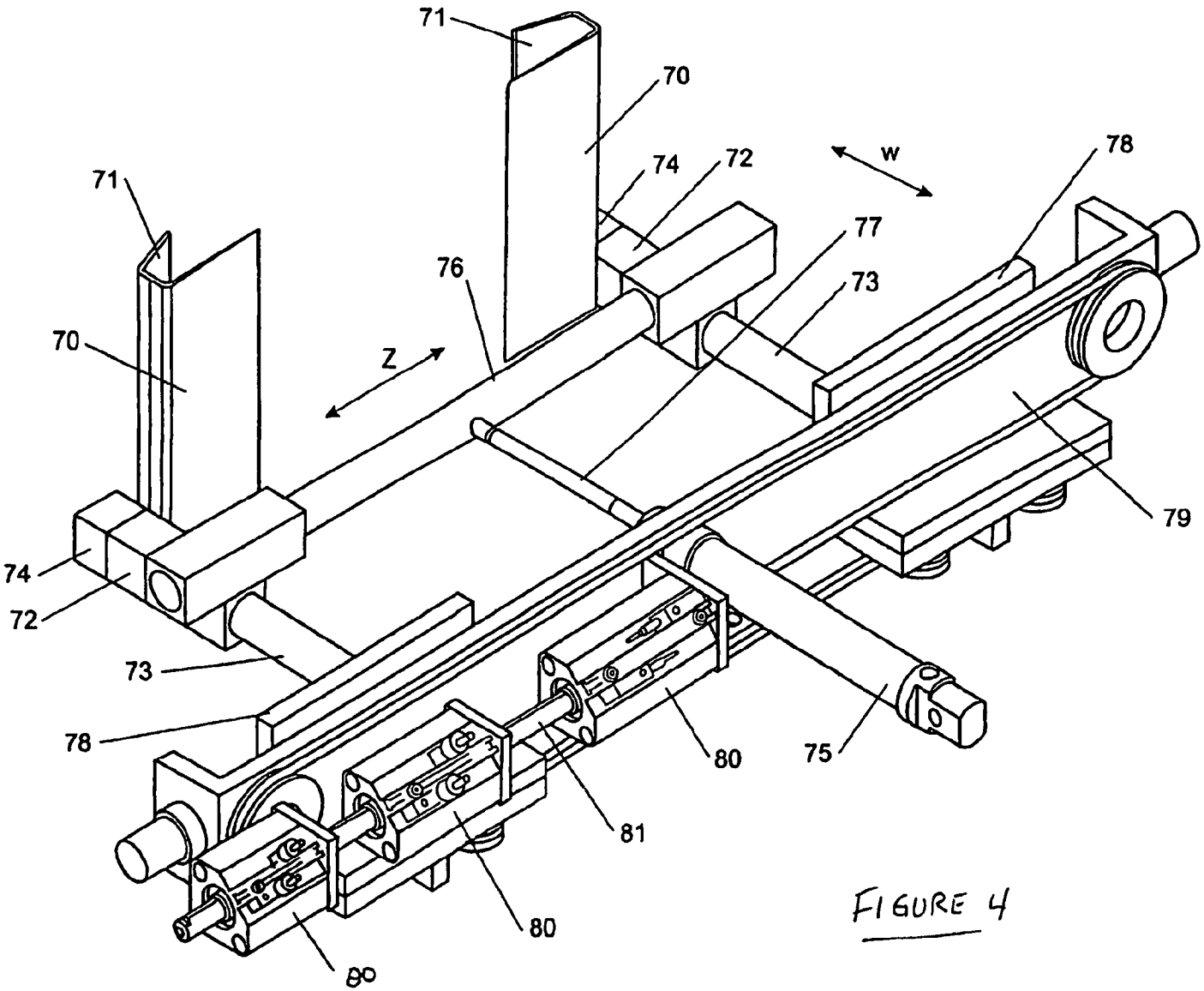
FIG. 4 is a schematic view of another embodiment of a bag opener.
Figure 5A:
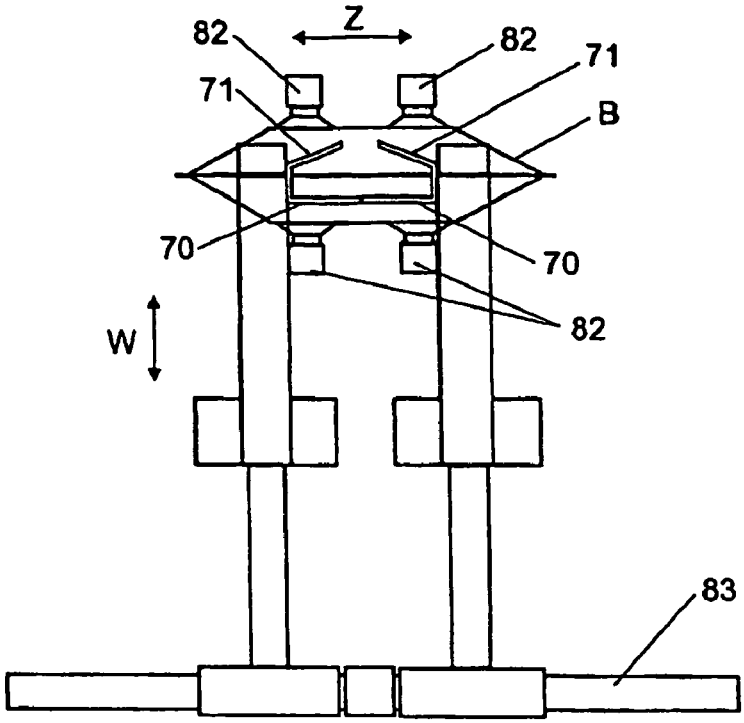
Figure 5B:
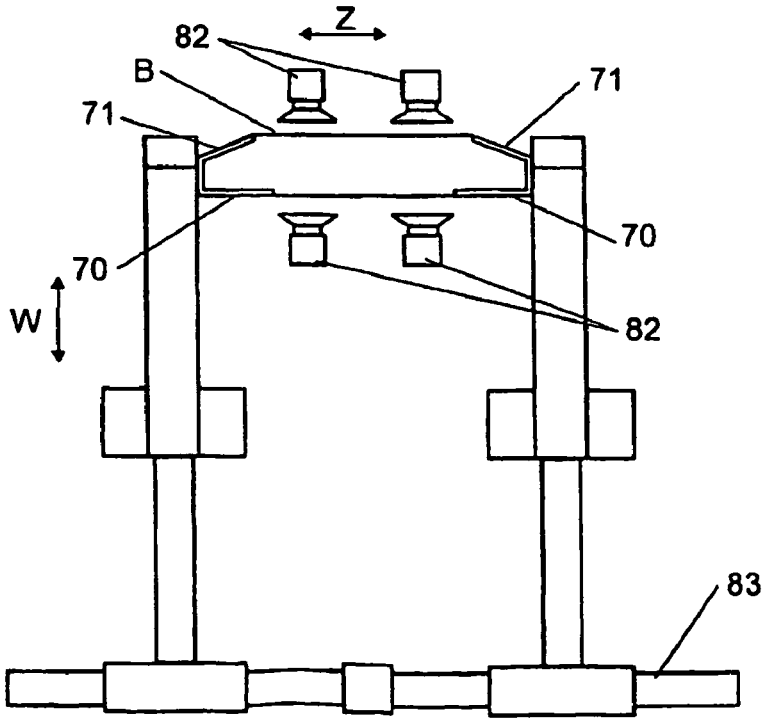

Another embodiment of the bag opener and its operation are shown in FIGS. 4 and 5A to 5E. The bag opener comprises four parts herein referred to as blades 70 and 71. The lower blades 70 are carried by mounts 72 which slidably move on shafts 73, and upper blades 71 are carried by mounts 74 fixed to the shaft 73. Pneumatic cylinder 75 can move the lower blades 70 vertically in the direction of arrow W in FIGS. 4 and 5. The mounts 72 carrying the lower blades 70 are connected by shaft 76 to which the shaft 77 of the pneumatic cylinder 75 is coupled. FIG. 5C (which does not show the operating cylinder 75) shows the lower blades 70 separated from the upper blades 71, and in the lowermost position of the lower blades 70. FIGS. 5A and 5B show the lower blades 70 in their upper most position. The lower and upper blade pair 70 and 71 on one side and the lower and upper blade pair 70 and 71 on the other side of the bag opener can be moved widthwise relative to one another in the direction of arrow Z in FIGS. 4 and 5 as shown. Referring to FIG. 4, the shafts 73 are in turn carried by left and right carriages 78 which are movably mounted on subframe 79. Subframe 79 also carries three operating cylinders 80 each having a different stroke length, on common shaft 81. The three cylinders together provide eight programmable widthwise positions in the direction of arrow W between the lower and upper blade pairs 70 and 71 on either side. In an alternative form there may be four cylinders which may provide for sixteen programmable width positions, or the cylinders may be replaced by a single variable stroke pneumatic or hydraulic cylinder, or in this or other bag openers described herein the cylinders 75 and 80 may be replaced by for example rack and pinion drive systems. FIGS. 5D and 5E schematically show a range of relative positions to which the blades 70 and 71 may be moved relative to one another. FIG. 5D shows how the bag opener may open the mouth of a bag of a particular width e.g. a 200 mm width plastic bag, to a range of mouth open shapes, between a maximum width-minimum height position, and a maximum height-minimum width position of the blades. FIG. 5E shows a similar range of positions to which the mouth of a larger bag e.g. in 300 mm width bag, may be opened by the bag opener.

Referring to FIGS. 5A and 5B, to initially separate the two sides of the mouth of a bag enabling the bag opener blades 70 and 71 to insert into the mouth of the bag, suction cups 82 may be provided above and below the bag mouth which may operate to grip either side of a bag and initially separate the two sides of the bag mouth, enabling the blades 70 and 71 of the bag opener to enter into the mouth of the bag. In FIG. 5A a bag is schematically indicated at B, held by suction cups while the blades 70 and 71 in their minimum width minimum height position insert into the mouth of the bag. Subsequently the left and right blade pair 70 and 71 may move apart widthwise, while the suction cups are released, to release the bag from the suction cups. The suction cups then move fully away from the bag or the bag opener blades carrying the bag may pivot around shaft 83 (see FIGS. 5A to 5C) to move the bag opener carrying the bag away from the suction cups, and the bag opener blades may then move to one of the positions shown in FIG. 5D or 5E to open the bag to enable loading into the bag of the product to be packed, or bringing of the bag over the product to be packed.

Figure 6:
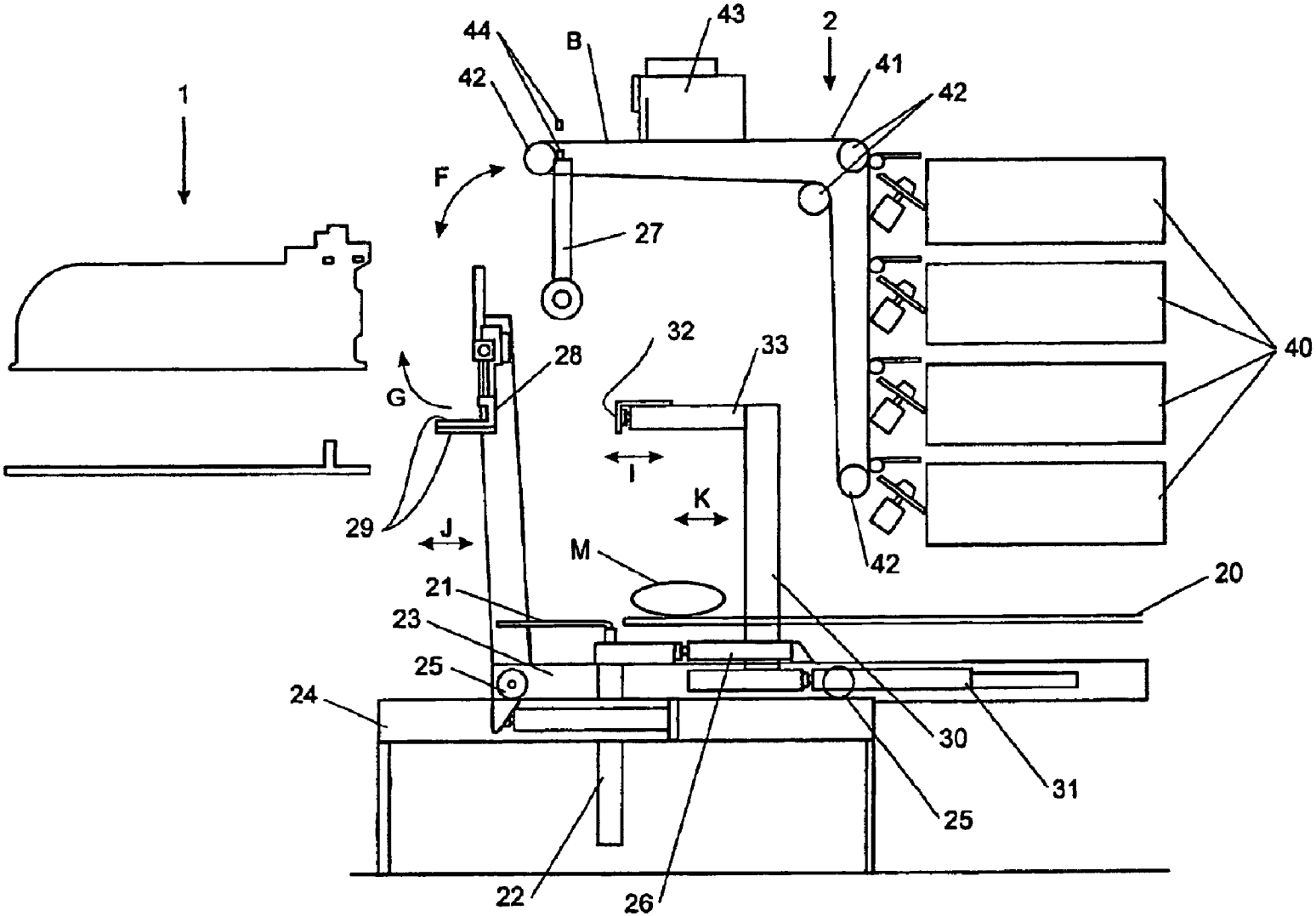
FIGS. 6 to 13 schematically show steps in the operation of another embodiment of a bag opener and a product loading system.
Figure 7:
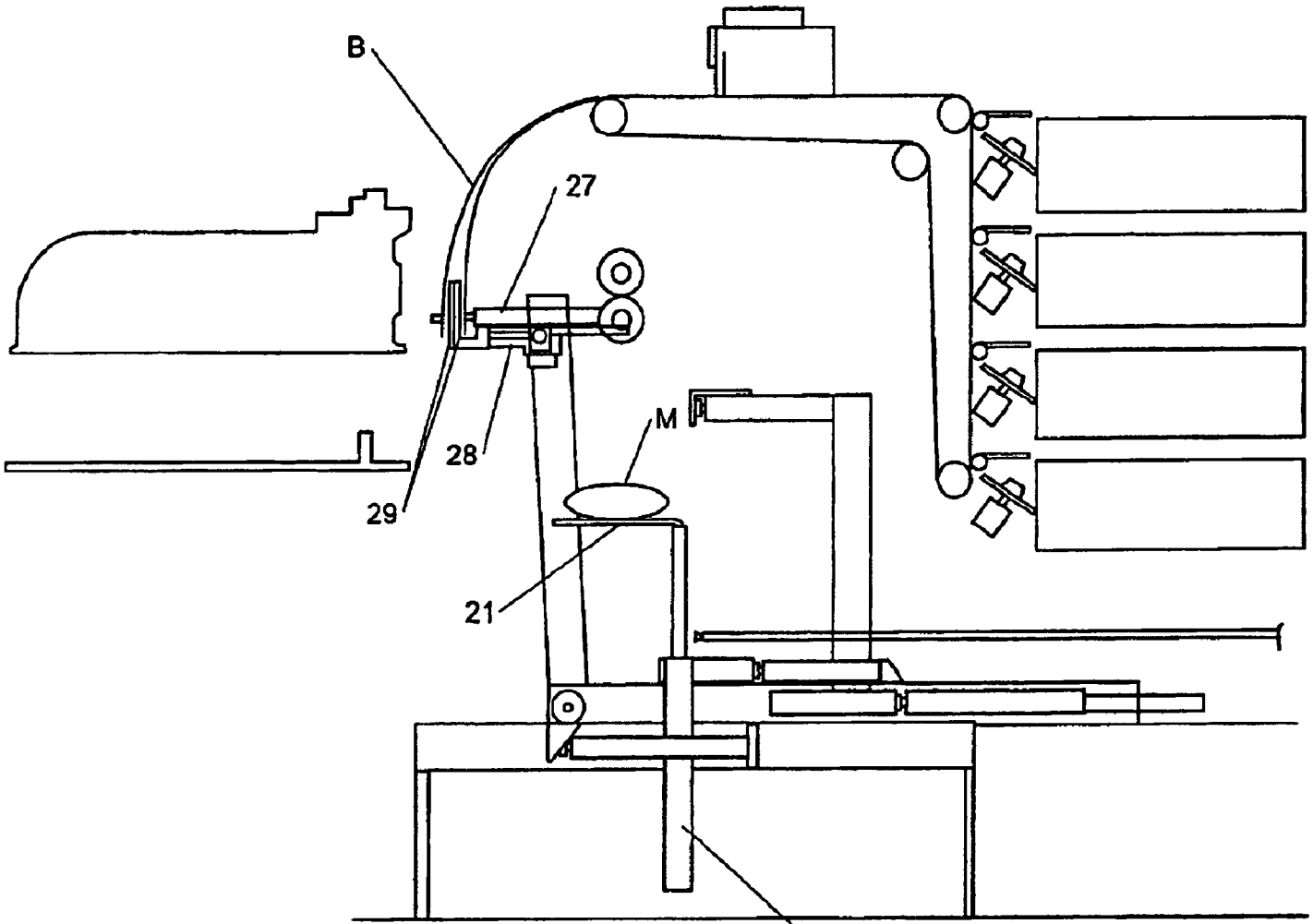
Figure 8:
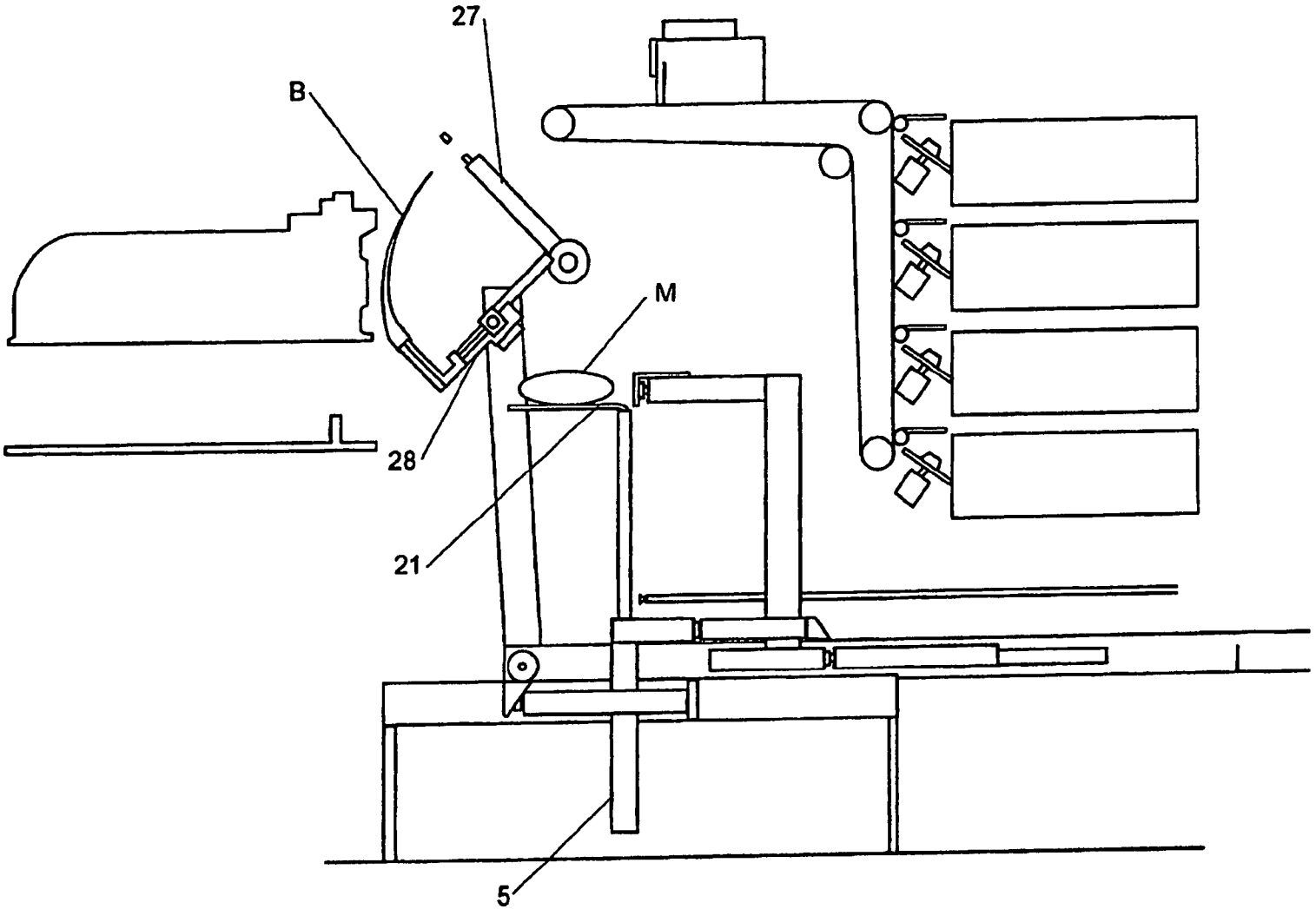

Another embodiment of a bag opener and product loading system and its operation is shown in FIGS. 6 to 13. In use meat cuts such as that indicated at M are carried by product supply conveyor 20. Meat cuts are delivered by the product supply conveyor 20 onto elevator plate 21 when it is in its lowered position as shown in FIG. 6, and are then elevated as shown in FIGS. 7 and 8. Movement of the elevator plate 21 is driven by hydraulic cylinder 22, which is in turn carried by a moving carriage assembly 23 which moves in the direction of arrow J in FIG. 6 on the machine bed 24. For example, the moving carriage assembly 23 may be moveably mounted to the machine bed 24 by wheels 25, and driven by hydraulic cylinder 26. When the product supply conveyor 20 has delivered the product onto the elevator plate 21, the forward telescoping end of the conveyor 20 withdraws.

Figure 9:
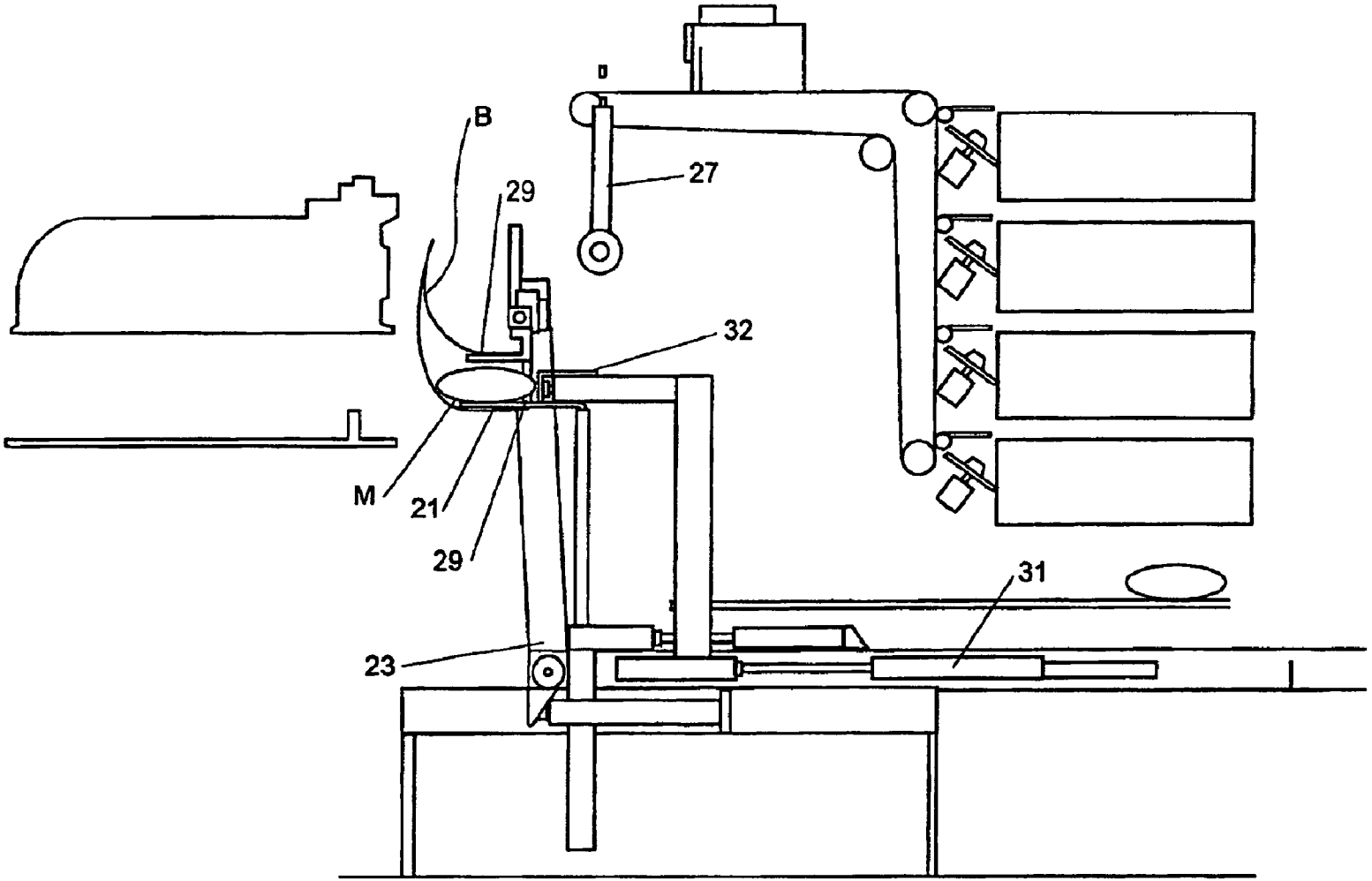

An empty bag such as bag B is picked up from a bulk supply as will be further described, the two sides of the bag mouth are separated, and the bag is brought down from the position shown in FIG. 6 to the position shown in FIG. 7 by pivoting bag pickup arm 27 which moves in the direction of arrow F in FIG. 6. The bag pickup arm 27 in its upper position shown in FIG. 6 picks up a fresh bag and then pivots down while at the same time arm 28 forming part of a bag opener and bag opener carrying bag opening means in the form of figures or spoon plates 29 moves upwardly to the position of FIG. 7. The partially open mouth of bag B is entered onto the fingers 29 of bag 28 as shown. The bag opener arm 28 having received a bag then pivots downwardly as shown in FIG. 8. As it does so the fingers 29 are driven apart to open the mouth of the bag further, e.g. to a desired extent to match the size of the approaching meat cut M, as will be further described. Movement of the bag opener arm 28 and the elevator plate 21 is coordinated so that the meat cut is presented to the bag opener arm 28 as it pivots downwardly as shown in FIG. 8, and in doing so enters the open mouth of the bag over the meat cut on the elevator plate as shown in FIG. 9.

Figure 10:
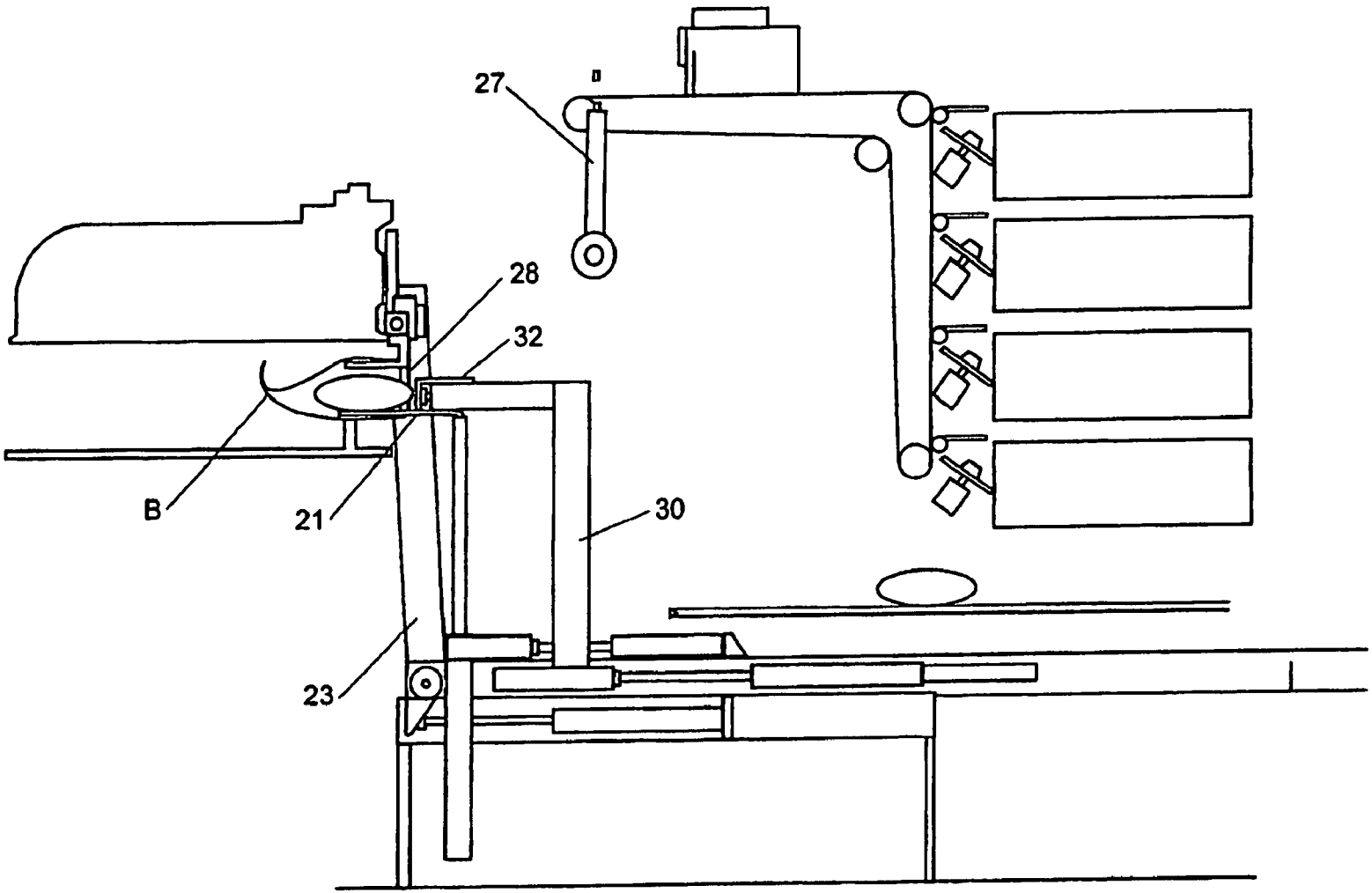
Figure 11:
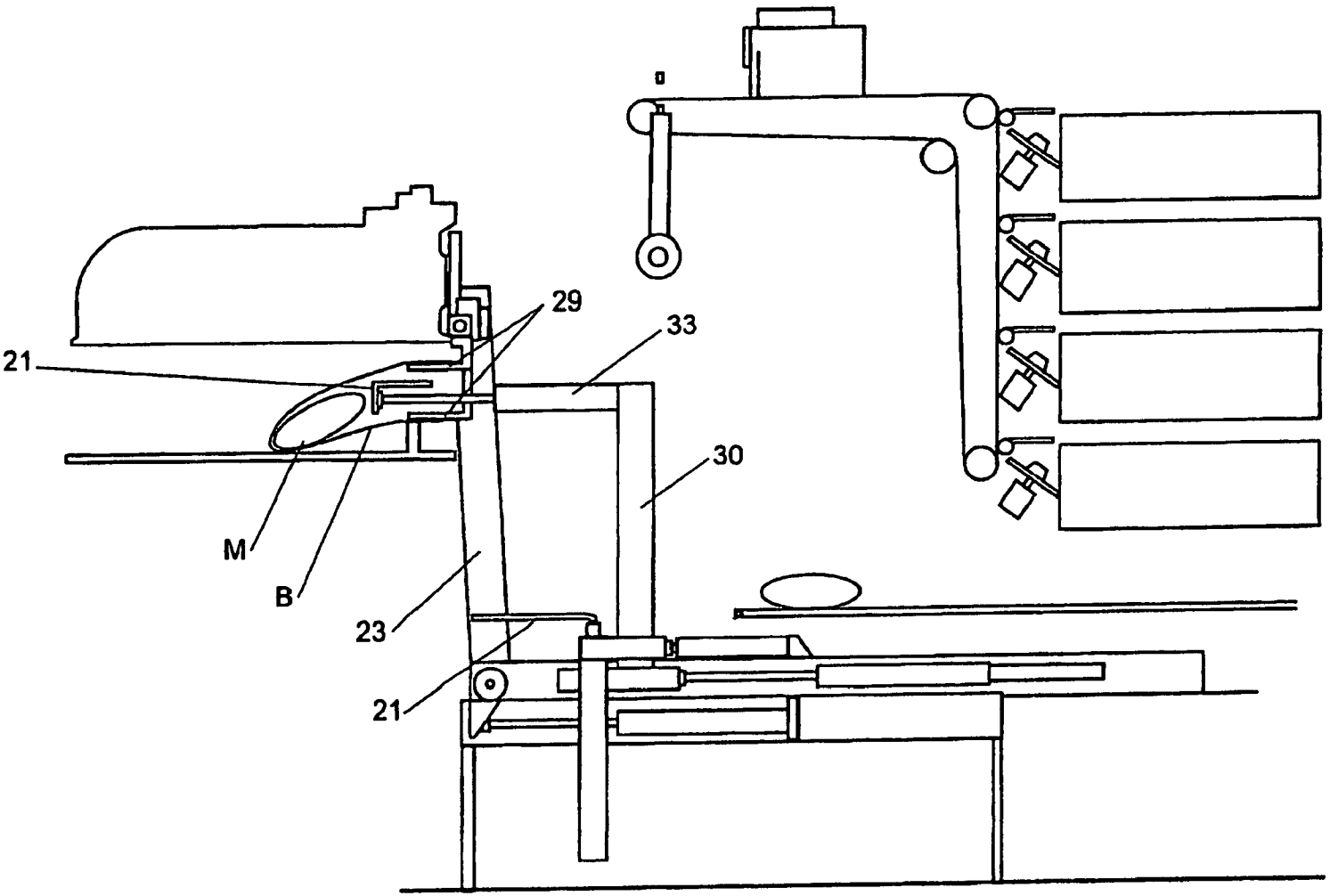
Figure 12:
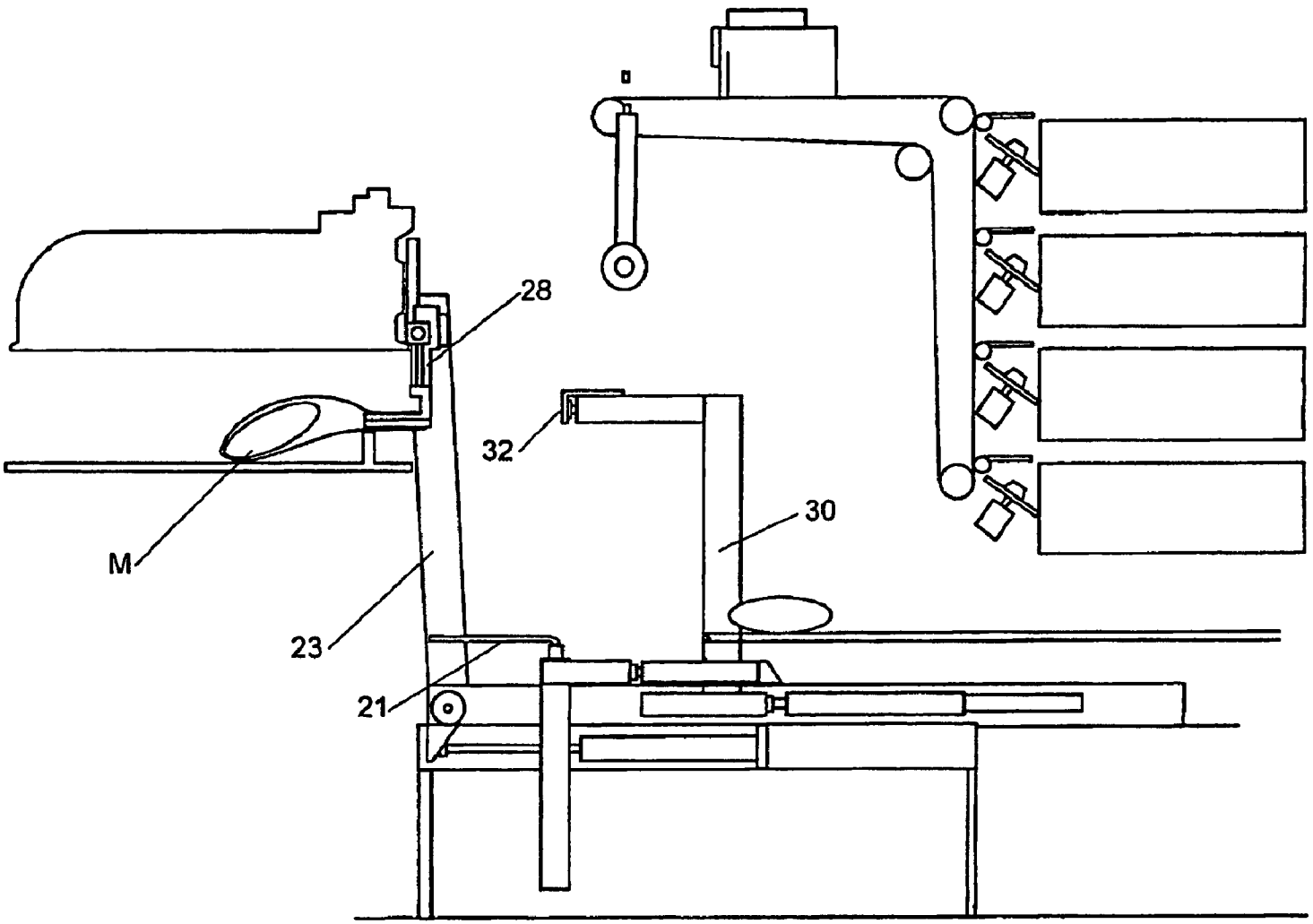
Figure 13:
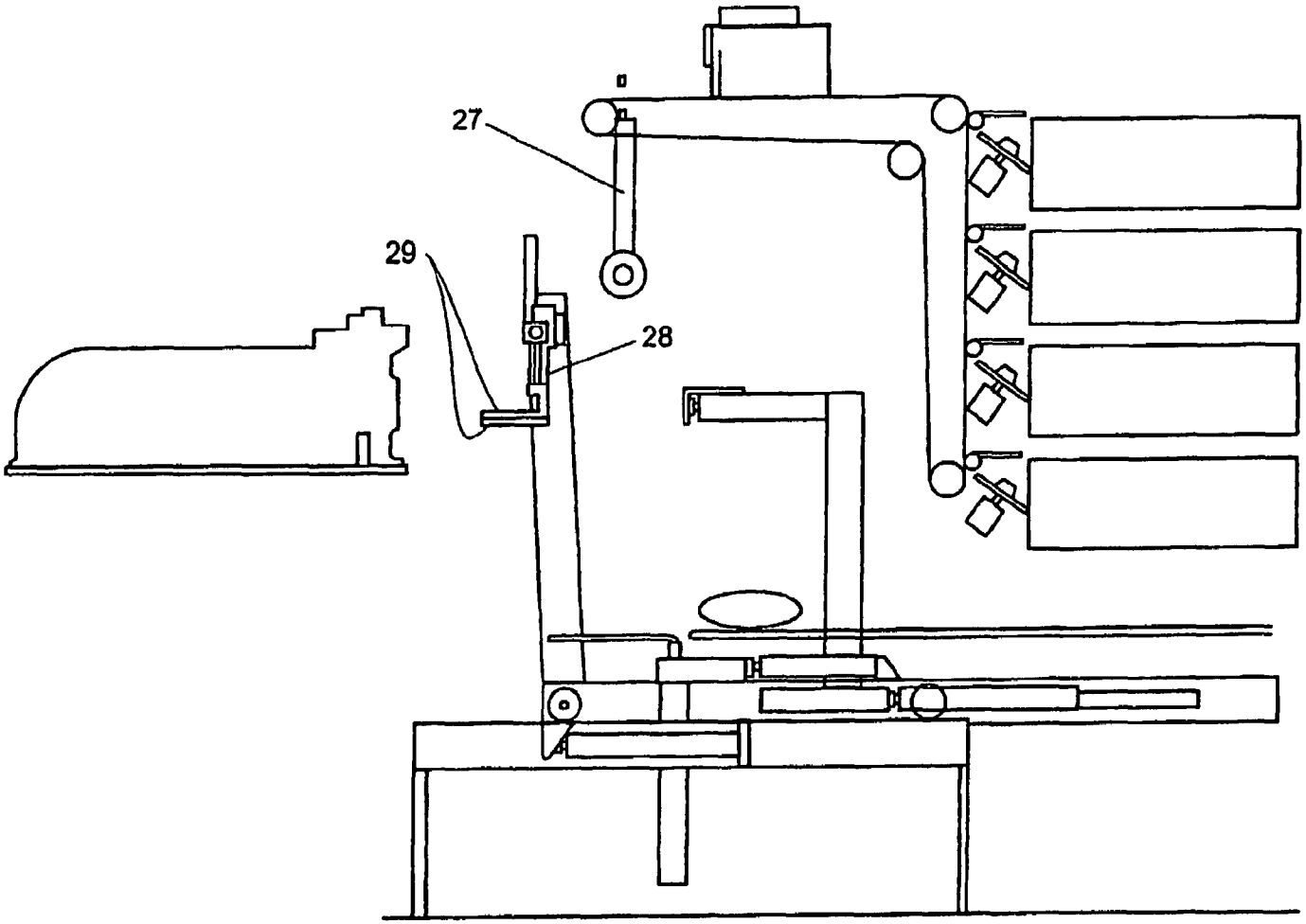

The carriage assembly 23 is then moved forward (by cylinder 26) to the position shown in FIG. 10 to carry the meat cut in the open mouth of the bag on the elevator plate, onto the conveyor as shown. At about the same time product ejector carriage 30 is moved forward as indicated by arrow K in FIG. 6. The product ejector carriage 30 is movably mounted in the machine bed 24 and may be driven by hydraulic cylinder 31 for example. The product ejector carriage carries ejector plate 32 which moves in the direction of arrow I in FIG. 6 relative to the product ejector carriage 30, and may be driven by a cylinder 33 carried by the product ejector carriage 30. Referring to FIG. 11 cylinder 33 is then actuated to move the ejector plate 32 forward to push the meat cut further into the bag, following which the ejector plate 32 withdraws, and product ejector carriage 30 moves back—see FIG. 12—while at about the same time the fingers 29 of the bag opener arm 28 close together and then withdraw. At about the same time or prior the product supply conveyor 30 operates to move the next meat cut onto the elevator plate 21 ready to load the next meat cut into a bag and into the next vacuum chamber in the same way.

The elevator plate 21 in the particular arrangement described lifts the products to the bag opener but an alternative arrangement may omit the elevator plate 21 and related parts and a product conveyor such as the product conveyor 20 may deliver the products directly to the bag opener.

As referred to above the bag opener arm 28 includes fingers or plate-like spoons 29 which insert between the separated sides of the mouth of a bag, and then move apart to open the bag mouth, preferably to a controlled degree of height or lift. Optionally similar fingers may be provided on either side which move in a lateral or width-wise direction to open the bag to a fixed or controlled degree of width opening. The degree of lift may be continuously variable dependent upon the size of each individual product or may be stepped between a number of predetermined levels of opening for products within broad size ranges. For each such a size the bag may be opened or spread laterally to a controlled degree which may be continuously variable dependent on product size, or to fixed steps of lateral opening. The lift opening fingers and optionally width opening fingers may be controlled by servo motors which adjust the position of the lift and lateral opening of fingers for each bag, by small pneumatic cylinders, or by any other suitable mechanical arrangement. The extent to which the spreader fingers 29 are driven apart to open the bag to a controlled extent is based on information provided from an earlier machine vision or similar product information acquisition stage through which each product passes.

A control system may control operation of the machine as described above, and may also synchronise the arrival of individual meat cuts with the acquired information relating to the individual meat cuts. In another arrangement acquired information relating to each product may be sent directly from a product information acquisition stage to the packing and vacuuming station and retained in a database at the packing and vacuuming station until that meat cut has arrived, and is then used to open the bag to the appropriate extent for that size of product. Alternatively, individual meat cuts may be tracked along a packing line so that the system can detect if any individual meat cut is removed from the product stream for any reason, to avoid mis-indexing of the meat cuts and bags, and this may be achieved by detecting and tracking the movement of each meat cut from one conveyor to the next.

Bags may be supplied from a stack or rolled stock or alternatively may be made on-line by cutting and sealing bags from tubes. A range of bag or stock widths may be available in a range of materials such as oxygen barrier materials, export grade packing material, and so forth from which the bags may be selected as directed by the control system. Bags preprinted with different labelling or branding information may also be provided and selected from. Referring to FIG. 6, in one embodiment bags may be supplied from bag magazines 40, each of which contains rolls of prefabricated bags of different sizes and/or types of bags with various properties e.g. different oxygen barrier or puncture properties or printed labelling information. Alternatively one or more of the bag magazines 40 may be replaced by one or more on line bag making machines (as are known in the art). As each meat cut approaches or is being loaded, the machine control system causes one of the bag magazines to present a bag to bag delivery conveyor 41, of the appropriate size and/or type for the particular meat cut. Bag delivery conveyor 41 passes around rollers 42, and picks up the bag from the selected bag magazine 40 and delivers it closed mouth first to the position of bag B in FIG. 6 ready for pick up by the bag pickup arm 27. The bags may pass below printer 43 and have information printed on the bag relating for example to the specific meat cut to be packaged e.g. weight or type information where the bags have already been pre-printed with more generic information such as branding information for example. To separate the two sides of the mouth of the bag ready for pick up by the bag pick up arm 27, one or more suction cups above and below the bag mouth may grip either side of the waiting bag and then move slightly apart to separate the two sides of the bag mouth. A series of suction cups or a longitudinally extending suction bar may be provided above and below the bag mouth. The control system moves the suction cups towards the bag mouth on either side and applies suction at the appropriate time, and releases the suction when the bag has been picked up by the bag pickup arm 27, to allow the bag pickup arm 27 to pivot downwardly to enter the bag mouth onto the fingers 29 of the bag opener arm 28. Alternative arrangements for initially separating the bag mouth may be used however.

FIGS. 14 to 17 show in plan view the layout and operation of another embodiment of a product loading conveyor system. Such a product loading conveyor system may be used as the conveyor 7 which delivers products to the bag openers of FIG. 2, 3 or 4 for example, or as the product conveyor 20 or equivalent which delivers products to the bag opener of FIGS. 6 to 13.

Referring to FIGS. 14 to 17, products of different sizes such as meat cuts M are loaded at a packing station 50 on parallel spaced conveyors 51. The meat cuts after packaging are carried away from packing station 50 on exit conveyor 52.

Figure 14:
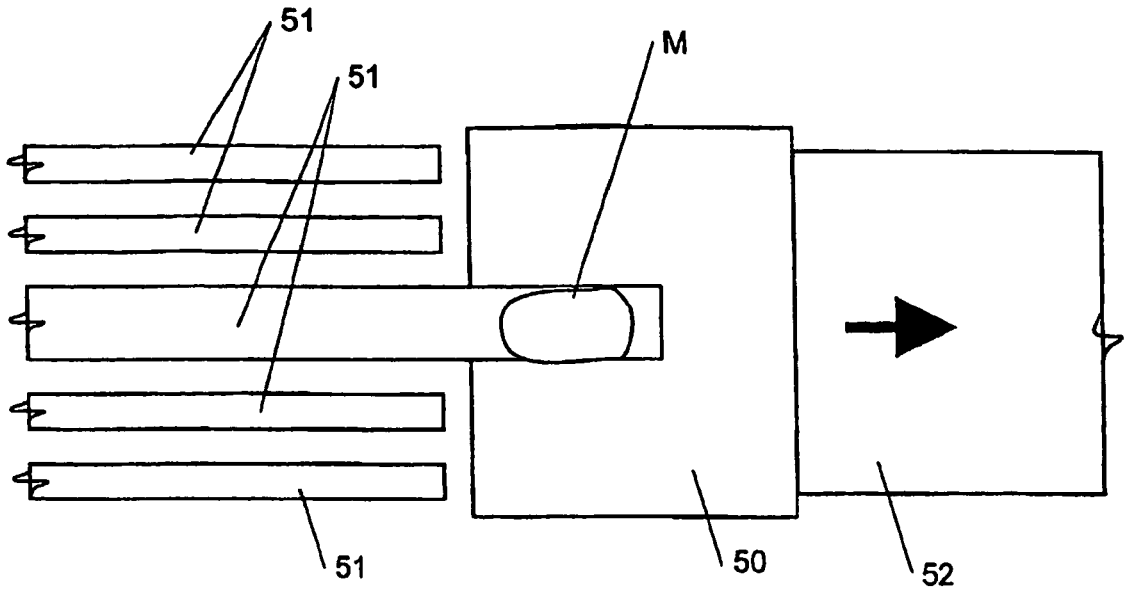
FIGS. 14 to 17 schematically show a plan view of the layout and operation of another embodiment of a product loading conveyor system.

Any one or more of the two or more conveyors 51 may be activated by a control system, dependent on the product size. For example when smaller meat cuts are identified by the product information acquisition stage they are directed to a center conveyor and only the center conveyor is activated, as shown in FIG. 14. A bag opener (not shown in FIGS. 14 to 17) 50 may present a smaller bag or a bag which is opened to a lesser extent, into which the smaller meat cut M on the center conveyor is delivered. The packing station may align the bags with the center conveyor. When the machine vision system identifies a meat cut of intermediate size such as indicated at M in FIG. 15, more of the input conveyors 50 are activated to load that meat cut. Referring to FIG. 16, when the machine vision stage identifies a yet larger meat cut M, all five of the input conveyors are activated to load the meat cuts in to a bag. The two or more conveyors need not necessarily be arranged in a "centered" configuration in which smaller meat cuts are delivered to the center conveyor. For example in an alternative configuration cuts can be aligned to one side with one, two, or more conveyors being activated based on the size of the cut. FIG. 17 shows conveyors to one side activated to load an intermediate size meat cut in a non-centered system.

Figure 15:
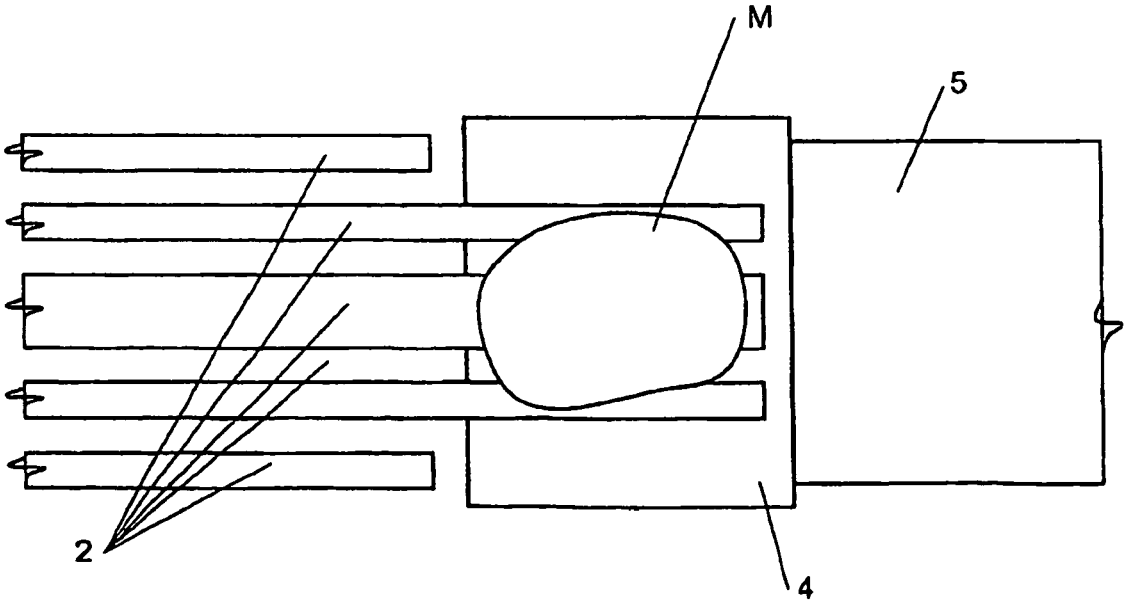
Figure 16:
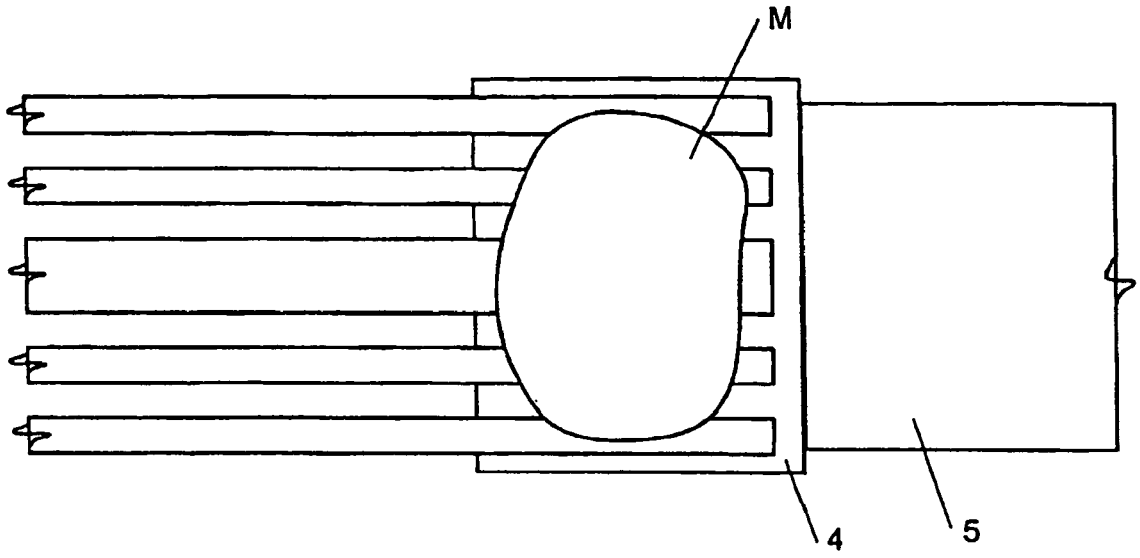
Figure 17:
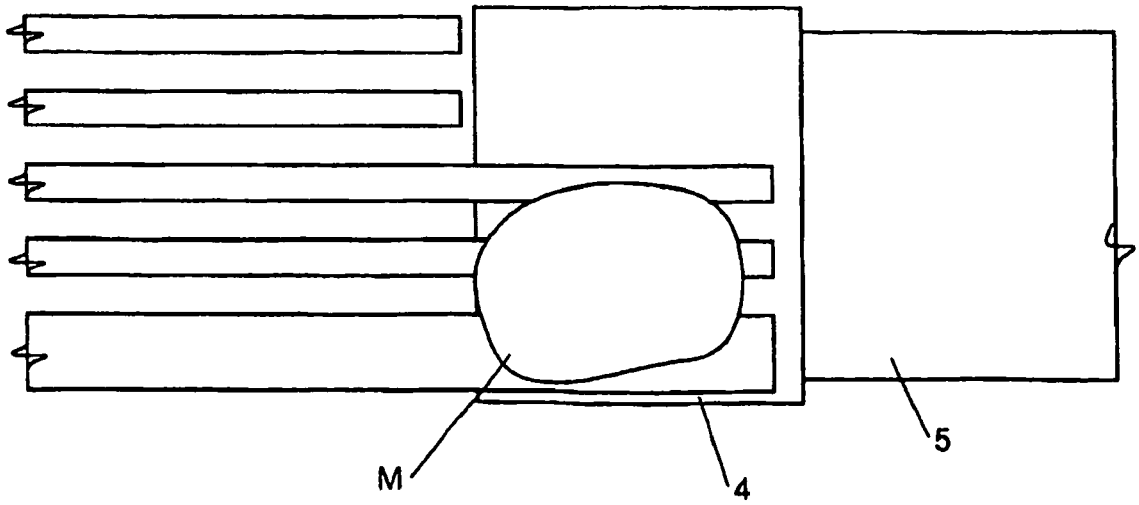

FIGS. 15 to 17 show five parallel conveyors including two conveyors on either side which are of lesser width than a center conveyor. Alternatively, the conveyor system may comprise two conveyors having similar widths or wherein one conveyor is wider than the other conveyor; three conveyors of similar widths or comprising a center conveyor flanked on either side by one or more other conveyors of lesser width, and so forth.

Referring back to FIG. 3, this as previously described shows one arrangement of a telescoping input conveyor system of the invention that may be used to load meat cuts M into open bags B. The forward end(s) of the one or more parallel load conveyor(s) (dependent on product size) may telescope into the bag which is presented to the meat cut, and then withdraw, depositing the meat cut within the bag, which is then carried away from the packing station on an exit conveyor. Operation of the input conveyors is controlled such that where smaller meat cuts are conveyed by a single one of the input conveyors, the open mouth of the bag is aligned with that input conveyor, which telescopically deposits the meat cut into the open bag. Where the meat cut and bag are larger, two or more of the input conveyors telescope together to deposit the meat cut into the open bag as described above, and the open bag is positioned laterally relative to the direction of forward movement of the input conveyors so that the bag is aligned with the input conveyors loading the meat cut. In one embodiment the conveyors are arranged to deliver products into the bags by telescoping or moving forward into the bags to an extent dependent upon the size of the product i.e. further for longer products than for shorter products, based on product size information previously acquired at the upstream product information acquisition stage.

Figure 18:
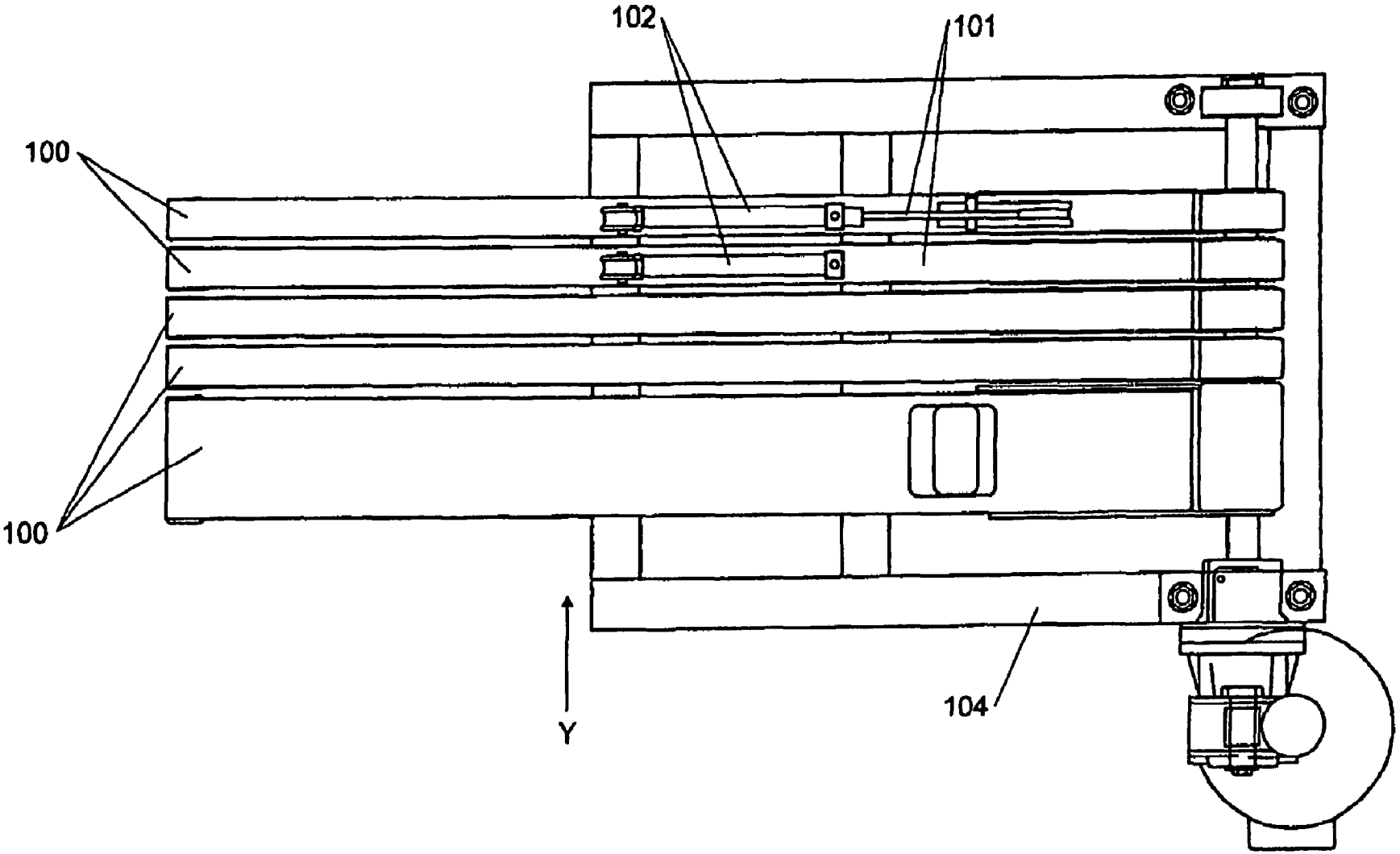
FIG. 18 shows a detailed plan view of a product loading conveyor system.
Figure 19:
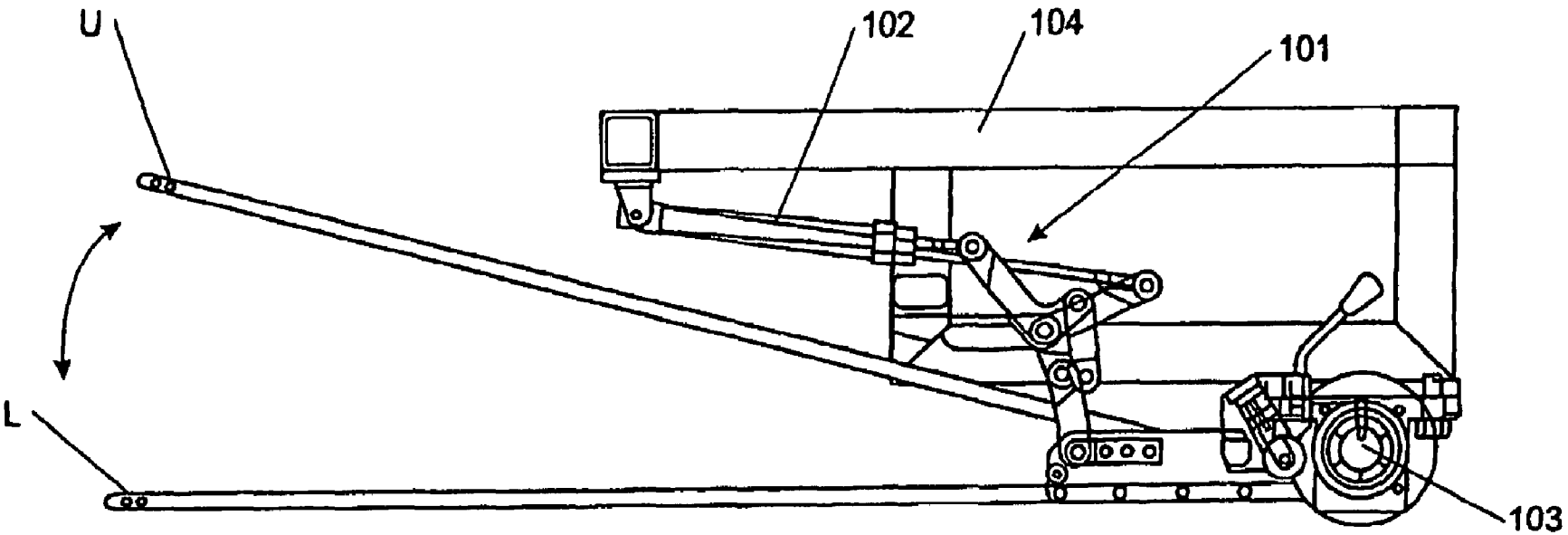
FIG. 19 shows the product loading conveyor system of FIG. 18 in the direction of arrow Y of FIG. 18.

FIGS. 18 and 19 show a conveyor system of the invention comprising five parallel conveyors. Referring to FIG. 18, any one or more of the lesser width conveyors 100 may be pivoted upwardly to the position of the conveyor indicated at U in FIG. 19, by mechanism 101 activated by operating cylinder 103 which operates about the primary shaft 102 of the conveyor system. In this embodiment, where the meat cut and bag are of maximum size, all of the five conveyors may be in the lower position indicated at L in FIG. 19 to convey the meat cut, into an open bag for example. Where the meat cut is of lesser size, one or more of the conveyors 100 may be caused to pivot out of the way to the upper position U so that the meat cut will be carried by a lesser number of the conveyors. A control system may control which combination of conveyors is used i.e. which remains at position L and which pivots to position U, dependent upon the size of the product, based on product size information previously acquired at the upstream product information acquisition stage.

The foregoing describes the invention including various embodiments thereof.

What is claimed is:

1. A method for packing products comprising:

a) at an upstream product information acquisition stage acquiring information relating to at least one of the height, width, length, volume, shape, and weight of individual products on a product packing line by any of the following methods:

i) using a digital camera system which sees individual meat cuts, ii) directing at least one beam or line from a scanning laser over individual meat cuts with deflection and/or reflection of laser light on the meat cut being seen by a camera system, and iii) using a series of horizontal and vertical beams across the conveyor path at different heights or spacings through which the meat cuts pass;

b) utilizing a machine for supplying bags sequentially as individual products on a conveyor approach a packing apparatus;

c) providing an automated bag opener comprising a frame carrying spreader fingers, the frame moveable between a first position, in the product stream, and a second position out of the product stream; and d) automatedly taking up on the automated bag opener a bag as each individual product approaches the bag opener, and machine opening a mouth of the bag to a variable extent of lift in a direction at approximately right angles to a major plane of the unopened bag and to a variable degree of width opening in a direction approximately in a major plane of the unopened bag, based on information relating to at least one of the height, width, length, volume, shape, and weight of the product acquired at the upstream product information acquisition stage;

wherein the bag opener moves repeatedly between i) a position out of the product stream in which the bag opener takes up a bag from the bag supply system, and ii) a position in the product stream for receiving a product in the bag after opening of the mouth thereof; and wherein the bag is taken up by i) rotating the frame to the second position, ii) inserting the spreader fingers into the bag;

iii) spreading the spreader fingers to pick up the bag, and iv) bringing the bag into a position in the product stream whereby the product can enter the bag.

2. The method of claim 1 comprising gripping the bag from the exterior on either side of a major plane of the bag at the mouth of the bag via suction grippers, to initially open the bag.

3. The method of claim 1 comprising making the bags on-line to a length tailored to the size of individual products by cutting and sealing bags from tubular stock.

4. The method of claim 1 wherein the frame is pivotally mounted, and pivots between a first position, in the product stream, and a second position out of the product stream, whereby when the frame is in the second position, the spreader fingers enter a bag out of the product stream, spread to pick up the bag, and bring the bag into a position in the product stream wherein the product can enter the bag.

5. An apparatus for packing of products comprising:

a) a product information acquisition stage arranged to acquire information relating to at least one of the height, width, length, volume, shape, and weight of individual products on a product packing line, wherein the product information acquisition stage comprises any of i) a digital camera system which sees individual meat cuts, ii) a system which directs at least one beam or line from a scanning laser over individual meat cuts with deflection and/or reflection of laser light on the meat cut being seen by a camera system, and iii) a series of horizontal and vertical beams across the conveyor path at different heights or spacings through which the meat cuts pass;

b) a bag supply system arranged to supply bags sequentially as individual products on a conveyor approach a packing apparatus; and c) a bag opener arranged to automatedly take up a bag from the bag supply system as each individual product approaches the bag opener, and to subsequently machine open a mouth of each bag to a variable extent of lift in a direction at approximately right angles to a major plane of the unopened bag and to a variable degree of width opening in a direction approximately in a major plane of the unopened bag, based on information relating to at least one of the height, width, length, volume, shape, and weight of the product acquired at the upstream product information acquisition stage;

wherein the bag opener is arranged to move repeatedly between i) a position out of the product stream in which the bag opener takes up a bag from the bag supply system, and ii) a position in the product stream for receiving a product in the bag after opening of the mouth thereof;

the bag opener comprising a frame carrying spreader fingers, the frame moveable between a first position, in the product stream, and a second position out of the product stream, whereby when the frame is in the second position, the spreader fingers can enter a bag out of the product stream, spread to pick up the bag, and bring the bag into a position in the product stream wherein the product can enter the bag.

6. The apparatus of claim 5 wherein the bag opener comprises suction grippers arranged to grip the bag from the exterior on either side of a major plane of the bag at the mouth of the bag to initially open the bag.

7. The apparatus of claim 5 wherein said bag supply system is arranged to make the bags on-line to a length tailored to the size of individual products by culling and sealing bags from tubular stock.

8. The apparatus of claim 5 wherein the frame is pivotally mounted, and pivotable between a first position, in the product stream, and a second position out of the product stream, whereby when the frame is in the second position, the spreader fingers can enter a bag out of the product stream, spread to pick up the bag, and bring the bag into a position in the product stream wherein the product can enter the bag.

* * * * *